US007514635B2

(12) United States Patent
Meier et al.

(10) Patent No.: US 7,514,635 B2
(45) Date of Patent: Apr. 7, 2009

(54) SHAFT, METHOD FOR PRODUCING IT AND DEVICE FOR CARRYING OUT THE METHOD

(75) Inventors: Guido Meier, Wurenlingen (CH); Leopold Ritzer, Untersiggenthal (CH); Stephane Page, Dubendorf (CH); Sanel Pidro, Holderbank (CH); Markus Keller, Zurich (CH); Olaf Hunger, Schaffhausen (CH); Marc Mollenkopf, Schonenwerd (CH)

(73) Assignee: ABB Research Ltd, Zurich (CH)

( * ) Notice: Subject to any disclaimer, the term of this patent is extended or adjusted under 35 U.S.C. 154(b) by 15 days.

(21) Appl. No.: 10/880,448

(22) Filed: Jul. 1, 2004

(65) Prior Publication Data

US 2005/0000722 A1 Jan. 6, 2005

(30) Foreign Application Priority Data

Jul. 2, 2003 (EP) ..... 03405489

(51) Int. Cl.
*H01B 7/00* (2006.01)

(52) U.S. Cl. ..... 174/135; 174/84 R; 174/85; 174/91; 174/88; 174/138 D

(58) Field of Classification Search ..... 174/84 R, 174/85, 91, 138 D, 88, 21 R, 21 JS, 21 JR, 174/31.5, 363, 73.1, 135, 6, 7
See application file for complete search history.

(56) References Cited

U.S. PATENT DOCUMENTS 3,261,910 A * 7/1966 Jacquier ..... 174/178
3,378,282 A * 4/1968 Demler, Sr. ..... 285/148.13
3,717,717 A * 2/1973 Cunningham et al. ..... 174/73.1

(Continued)

FOREIGN PATENT DOCUMENTS

DE 3218521 * 11/1983

(Continued)

OTHER PUBLICATIONS

English Abstract for DE 3218521.*

*Primary Examiner*—Dhiru R Patel
(74) *Attorney, Agent, or Firm*—Buchanan Ingersoll & Rooney PC

(57) ABSTRACT

The shaft includes two electrically conducting connecting pieces (2, 3), which can be connected to different electric potentials, and also an insulating tube (4), which can be subjected to torsional loading. The two connecting pieces (2, 3) are respectively fastened to one of the two ends of the insulating tube (4). In order that the shaft can also transmit great torques, the following means are provided for fastening at least one of the two connecting pieces (2, 3):

An adhesive joint (5), which is formed by a cone (6) formed into one end of the insulating tube (4) and made to run from the circumferential surface (7) to the inner surface (8) of the insulating tube (4) and also by a mating cone (9) formed into the at least one connecting piece (2, 3), and by a gap (10) formed by the cone (6) and mating cone (9) and filled with adhesive.

Alternatively, the fastening means may also include an embedding, which has a portion of the at least one connecting piece, made to extend in the direction of the axis of the insulating tube, as the part to be embedded, and the end portion of the insulating tube produced by a casting process, as the embedding body.

14 Claims, 3 Drawing Sheets

U.S. PATENT DOCUMENTS

| | | | | | |
|---|---|---|---|---|---|
| 4,688,969 | A | * | 8/1987 | Bruser et al. | 405/303 |
| 4,786,760 | A | * | 11/1988 | Friedhelm | 174/84 R |
| 4,828,634 | A | * | 5/1989 | Nielsen | 156/49 |
| 4,883,925 | A | * | 11/1989 | Graf | 174/84 R |
| 4,886,944 | A | * | 12/1989 | Christopher et al. | 200/48 R |
| 6,555,751 | B1 | * | 4/2003 | Umeki et al. | 174/75 R |

FOREIGN PATENT DOCUMENTS

| | | | |
|---|---|---|---|
| DE | 3641632 | A | 6/1988 |
| DE | 19737995 | A | 3/1999 |
| EP | 0899764 | A | 3/1999 |
| GB | 2053766 | A | 2/1981 |

* cited by examiner

SHAFT, METHOD FOR PRODUCING IT AND DEVICE FOR CARRYING OUT THE METHOD

TECHNICAL FIELD

The invention is based on a shaft according to the precharacterizing clause of patent claim 1. The shaft is of an axially symmetrical form and includes two electrically conducting connecting pieces, which can be connected to different electric potentials, and also an insulating tube, which can be subjected to torsional loading. The two connecting pieces are respectively fastened to one of the two ends of the insulating tube. A torque introduced into one of the two connecting pieces by a drive is .transmitted via the insulating tube to the second connecting piece and passed from there to an actuating device. Because of the insulating tube arranged between the two connecting pieces, the two connecting pieces can be kept at different electric potentials, so that such a shaft can be used in particular as a rotary shaft in electrical apparatuses carrying high voltage, in particular switches.

The invention also relates to a method for producing such a shaft and also to a device for carrying out the method.

PRIOR ART

With the precharacterizing clause, the invention refers to a prior art of shafts such as that described for instance in DE 101 18 473 A. The shaft described transmits a rotational movement between two machine parts at different electric potentials. To avoid spark-over, the shaft bears a widened portion formed as an insulating disk.

In DE 36 41 632 A1 there is a description of a method for producing a fiber-reinforced push or pull rod. This rod has several layers of synthetic fibers, which are fixed in a cured polymer compound. The fibers are held with positive engagement in recesses which are made to run in an annular form around the rod axis and are formed in conical outer faces of two fittings of the rod. To improve the positive engagement, a ring covering the layers of fiber is provided. This ring reinforces the positive engagement between the layers of fiber disposed in the recesses and the fittings. In this way particularly high compressive or tensile forces can be transmitted.

A force transmission element likewise used as a thrust rod is described in DE 33 22 132 A1. This force transmission element has an electrically insulating, fiber-reinforced plastic rod. Formed into at least one of the two ends of the plastic rod are constrictions, into which projections of an end portion, formed as a sleeve, of a steel connection fitting protrude. After fitting the sleeve onto the end of the rod, the projections are produced by rolling of the sleeve. As a result, when there is a thrust movement, positive engagement is achieved between the plastic rod and the connection fitting. Furthermore, play between the rod and the fitting is eliminated, and so the non-positive engagement improved, by adhesive which is provided in a gap formed between the sleeve and the end of the rod.

A force transmission element in which two metal connection fittings are spaced apart from each other by an insulating tube based on LCP material is described in EP899 764 A1. Non-positive engagement between the fittings and the insulating tube is achieved by a press fit and/or by adhesive bonding.

Furthermore, it is known from the textbook "Feinmechanische Bauelemente" [precision components] by S. Hildebrand, VEB Verlag Technik, Berlin, 4th edition (1980), in particular page 167 et seq., that embeddings constitute welldefined, rigid, unreleasable and positive connections between fixed, mostly metallic parts and parts which consist of materials that are plastically deformable (castable, extrudable/moldable) and often subsequently cure.

SUMMARY OF THE INVENTION

The invention, as it is defined in patent claims 1 to 17, achieves the object of providing a shaft of the type stated at the beginning which is distinguished by good transmission behavior when great torques occur, and of providing a method with which such a shaft can be produced in a particularly conservative way, and also a device for carrying out the method.

In the case of a first embodiment of the invention, good transmission behavior of the shaft is achieved by an adhesive joint which is formed by a cone formed into one end of the insulating tube and made to run from the circumferential surface to the inner surface of the insulating tube and also by a mating cone formed into one of the two connecting pieces and by a gap formed by the cone and mating cone and filled with adhesive. The fact that the adhesive gap extends from the inner surface of the insulating tube to the circumferential surface of the latter has the effect that, during rotation, force is introduced from the adhesive joint directly into the entire material of the insulating tube present in the tube cross section. This avoids strong shearing forces, which occur in the case of shafts on which an adhesive gap is provided merely between the fitting and the circumferential surface.

If the material of the insulating tube contains a fiber-reinforced polymer and the fiber reinforcement is formed by winding fibers laid layer by layer, then, during rotation, force is introduced from the adhesive joint directly into all the layers of fiber present in the tube cross section. The cone should then intersect the layers at an angle of about 10 to 30°, in relation to the axis of the insulating tube. It has been found that the adhesive layer then introduces the force to be transmitted into virtually all the layers of fiber in a particularly uniform manner, with the effect in particular of enhancing the transmission of great torques in a particularly effective way.

Since, when the fastening means is provided in the form of an adhesive joint, there is in the shaft a cavity bounded by the inner surface of the insulating tube and the connecting pieces, it is recommendable to reduce undesirably high pressure in the cavity by a pressure-equalizing channel made to run from the outside into the cavity.

In the case of a second embodiment of the invention, good transmission behavior of the shaft is achieved by an embedding, which is formed by an end portion of one of the two connecting pieces, as the part to be embedded, and by an end portion of the insulating tube produced by a casting process, as the embedding body, in which embedding the end portion of the connecting piece has a profile other than that of a circle. The embedding achieves positive engagement and freedom from play between the embedded connecting piece and the insulating tube and in this way allows great torques to be transmitted independently of an adhesive joint. Since this shaft is produced by a casting technique, there is no need for machining of the insulating tube or for the connecting pieces to be bonded in place, and good quality of the insulating tube, and consequently also of the shaft, in particular with regard to their dielectric and mechanical properties, can be achieved by maintaining very precise control over the casting process.

In the case of the second embodiment of the shaft according to the invention, at least one of the connecting pieces expediently has a longitudinal channel made to run in the direction of the axis of the insulating tube. A flexible molding used during the production of the insulating tube for supporting the inner wall can be removed through this channel after the production process.

Once the fiber reinforcement of the insulating tube has been formed by winding fibers laid layer by layer, it is recommendable additionally to provide reinforcing fibers running through the layers of fiber. With a proportion of predominantly radially running reinforcing fibers of about 0.5 to 5%, preferably 1 to 3%, of the fiber reinforcement, a particularly high torsional strength of the insulating tube, and consequently also of the shaft, is achieved.

A method with which the second embodiment of the invention can be produced particularly simply is characterized by the following method steps:

(1) a preform corresponding largely to the finished shaft with regard to its geometrical dimensions is formed from the connecting pieces and a tubular fiber body,
(2) the fiber body and a portion of the preform which comprises parts of the two connecting pieces enclosed by the fiber body is placed into a casting mold,
(3) the fiber body is impregnated with liquid polymer in the casting mold, and
(4) the polymer-impregnated fiber body is cured, thereby forming the insulating tube fixing the connecting pieces.

In the case of this method, there is no longer any need for the insulating tube to be produced separately from the production process of the shaft, for machining of the insulating tube or for the connecting pieces to be bonded in place. Since the production process of the insulating tube is directly part of the production process of the shaft, the production parameters can be kept under very precise control, whereby good quality of the shaft, in particular with regard to its dielectric and mechanical properties, is achieved.

In a preferred development of this method, the inner surface and the circumferential surface of the tubular fiber body are: supported by flexible gas- and liquid-impermeable moldings before they are introduced into a casting mold. When the method is being carried out, the shaping process of the insulating tube can then be influenced in a controlled manner. At the same time, after curing, the moldings can be removed without being destroyed, after elastic deformation.

It is advantageous for the flexible molding that supports the circumferential surface to be made to expand in the radial direction before it is applied to the fiber body. This measure makes it easier for the molding to be applied to the fiber body and even makes it possible to subject the fiber body to a prestress that favorably influences the shaping of the insulating tube, and consequently also of the force transmission element.

The shaping, and in particular quality, of the insulating tube, and consequently also of the force transmission element, can be influenced in a particularly favorable way if the moldings are subjected to pressure during curing. Depending on the level of the pressure, unavoidable gas bubbles in the liquid polymer, in the fiber body or on the portions to be embedded of the connecting pieces are thereby largely suppressed by compression, and consequently the dielectric properties of the shaft are improved quite significantly.

In order to achieve a shaft that is mechanically particularly stable by simple means, the fiber body should be produced by winding a number of layers of fiber onto a winding core, and the winding core should be formed by the connecting pieces and the flexible molding supporting the inner surface of the fiber body.

If, during the production of the fiber body, predominantly radially aligned reinforcing fibers are additionally made to run through the layers of fiber, the torsional strength of the shaft is considerably improved by comparatively simple means.

To allow the flexible molding supporting the inner surface of the fiber body to be reused, it is recommendable to make one of the two connecting pieces hollow. The molding can then be elastically deformed, and removed without being destroyed to the outside through the cavity, after the curing of the generally thermosetting or thermoplastic polymer. Penetration of liquid polymer into the cavity during the impregnating of the fiber body is avoided if the flexible molding supporting the inner surface of the fiber body is subjected to high-pressure gas.

An advantageous device for carrying out the method according to the invention has a casting mold with at least five openings, of which a first and a second serve for leading through the two connecting pieces, a third serves for supplying the liquid polymer, a fourth serves for venting the casting mold and a fifth serves for supplying high-pressure gas, which high-pressure gas acts on the impregnated fiber body in a shaping manner during the curing of the liquid polymer.

The device preferably also includes a winding tool with a winding core, which is formed by the two connecting pieces and a flexible molding arranged between the two connecting pieces and serves for receiving the fiber body. The device also advantageously has, furthermore, a shrink-fitting tool, with a hollow-cylindrically formed vacuum chamber, the two end faces of which respectively contain an opening for leading through the winding core wound with the fiber body, and also a sealing face arranged in the interior of the chamber, made to run radially and enclosing the opening, on which sealing face the annular edge of a hollow-cylindrically formed flexible molding is supported in a vacuum-tight manner.

DESCRIPTION OF THE DRAWINGS

Preferred exemplary embodiments of the invention and the further advantages that can be achieved with it are explained in more detail below on the basis of drawings, in which.

WAYS OF IMPLEMENTING THE INVENTION

Figure 1:
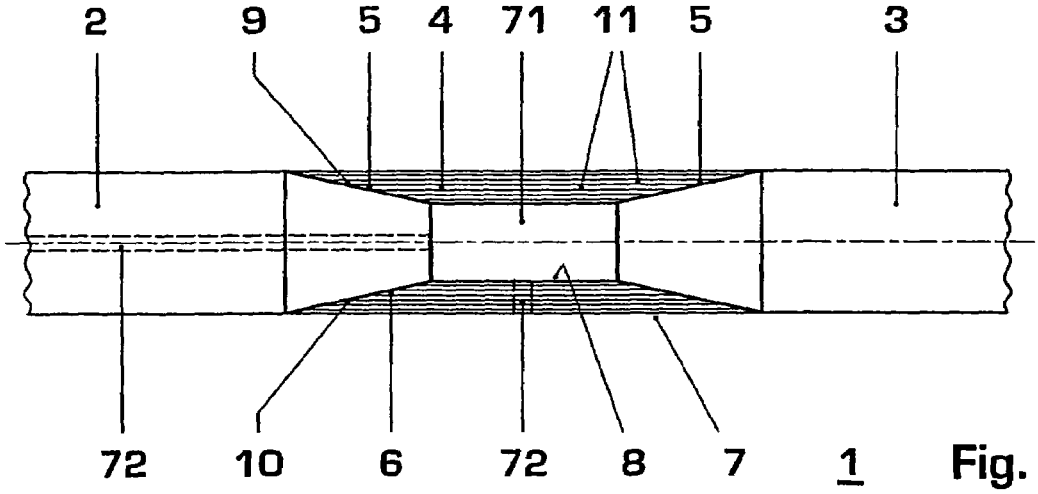
FIG. 1 shows a side view of a first embodiment of the shaft according to the invention, in which an insulating tube is represented in axial section.

In all the figures, the same reference numerals also designate parts that act in the same way. The embodiments of a shaft 1 according to the invention represented in FIGS. 1 and 2 respectively include two connecting pieces 2, 3 made of electrically conducting material, for example made of aluminum, which can be connected to different electric potentials, and also a tube 4 made of electrically insulating material based on a fiber-reinforced polymer with good mechanical, thermal and electrical properties, which can be subjected to torsion. Particularly suitable as reinforcing fibers are synthetic fibers, for instance based on aramid or polyester, but also inorganic fibers, for instance glass fibers. For production engineering reasons and for reasons of good mechanical strength in the transmission of torques, it is favorable to use fibers which are arranged in laid structures in which the fibers are arranged at an angle of about 30° to 60°, typically about 45°, to the axis of the shaft. Instead of laid structures, however, in principle woven structures or mats may also be used as fiber reinforcement, or the fibers may be laid as strands with the aid of a winding process. Suitable in particular as the polymer are resins based on epoxy or polyester. To improve the adhesion of the polymeric resin, it is possibly advantageous to coat the portions of the connecting pieces 2, 3 that are surrounded by fibers with a primer. The two connecting pieces 2, 3 are each fastened to one of the two ends of the insulating tube 4. Such a shaft 1 can, for example, be kept at ground potential with the connecting piece 2 and connected to high-voltage potential with the connection piece 3. Force can then be transmitted by a drive (not represented), which is arranged at ground potential, via the shaft 1 to an element to be driven, for example a contact arrangement of a high-voltage switchgear. By suitable fastening of the connecting pieces 2, 3 to the end of the insulating tube 4, a great torque can be transmitted, and consequently high acceleration of the element to be driven can be achieved, even with small dimensions of the shaft 1.

In the case of the embodiment of the shaft according to FIG. 1, the fastening is achieved by two adhesive joints 5, which are respectively formed by a cone 6 formed into one end of the insulating tube and made to run from the circumferential surface 7 to the inner surface 8 of the insulating tube 4 and also by a mating cone 9 formed into the connecting piece 2 or 3, respectively, and by a gap 10 formed by the cone 6 and mating cone 9 and filled with adhesive. The adhesive joints 5 extend from the inner surface 8 of the insulating tube 4 to the circumferential surface 7 of the latter. This has the effect that force is introduced from the adhesive joint 5 directly into all the fibers of the fiber reinforcement present in the tube cross section. This minimizes shearing forces between the individual fibers, which occur in the case of transmission elements according to the prior art, in which an adhesive joint is merely present between the circumferential surface 7 and the connecting piece 2 or 3. Since the force is introduced via all the layers of fiber of the tube cross section, the force transmission element can accept not only great torques, but also great tensile forces. It is therefore suitable not only as a shaft but also as a pull rod. When used as a pull rod, however, it is recommendable to arrange the fibers predominantly in the tensile direction, in order to increase the tensile strength.

If, in a way corresponding to the representation in FIG. 1, the fiber reinforcement of the insulating tube 4 is formed by winding fibers 11 laid layer by ate layer, the cone 6 should intersect the layers of fiber 11 at an angle of about 10 to 30°, in relation to the axis of the insulating tube. It has been found that, when the force transmission element 1 is loaded with torque, the adhesive joint 5 can introduce the force to be transmitted into virtually all the layers of fiber 11 simultaneously and uniformly. This development of the shaft 1 can therefore transmit particularly great torques.

The shaft 1 in the form according to FIG. 1 can be produced as specified below:

cutting to length of a preform of the insulating tube 4 from an insulating tube of great length prefabricated by wet-winding, forming of the cones 6 into the preform by turning and/or grinding, forming of the mating cones 9 into the two connecting pieces 2 and 3, pretreating of the cones 6 and the mating cones 9 with a suitable adhesive, for instance epoxy-based, joining the insulating tube 4 and connecting pieces 2, 3 together to form the narrow adhesive gap 10, and curing of the adhesive to form the shaft 1.

Alternatively, however, the insulating tube 4 may also be produced by pultrusion or by some other method that is suitable for the production of fiber-reinforced polymer tubes.

During the production of the shaft 1 there forms a cavity 71, bounded by the inner surface 8 of the insulating tube 4 and the connecting pieces 2, 3. This cavity is virtually gas-tight. To prevent undesired pressure in the cavity during the adhesive bonding during the production operation or later because of increased temperatures during operation of the shaft 1, the cavity 71 opens out into a pressure-equalizing channel 72 made to run to the outside. This channel connects the cavity 71 to the exterior space surrounding the shaft 1 and in this way reduces a positive pressure possibly occurring in the cavity For reasons of favorable electrical behavior of the shaft, this channel is advantageously provided in regions of the shaft that are subjected to low dielectric loading and—as FIG. 1 reveals—is advantageously made to run radially through the wall of the insulating tube 4 and arranged midway between the two connecting pieces 2, 3 and/or made to run axially through one of the connecting pieces 2, 3. The pressure-equalizing channel is typically formed as a bore with a diameter of several mm, for example 2 to 4 mm.

Figure 2:
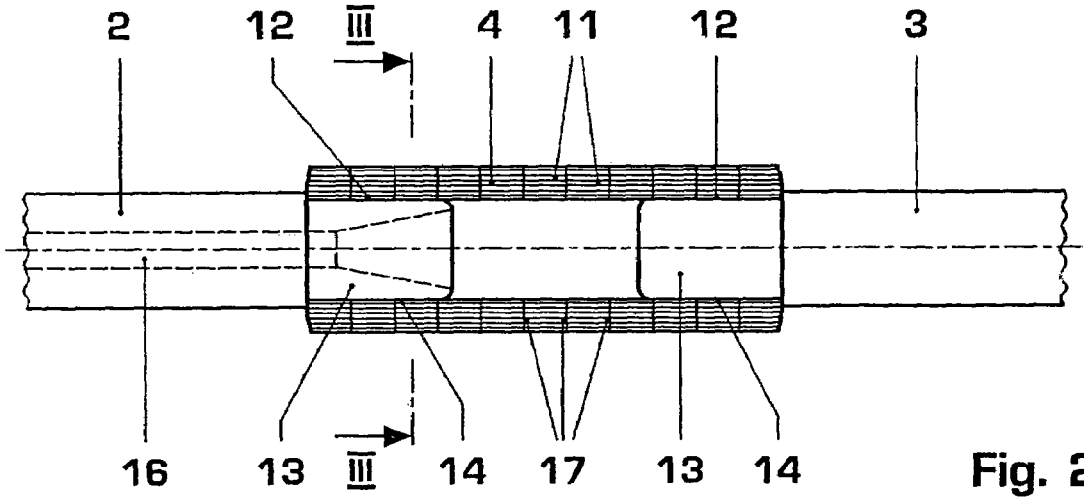
FIG. 2 shows a side view of a second embodiment of the shaft according to the invention, in which an insulating tube is likewise represented in section.

In the case of the embodiment of the shaft according to FIG. 2, the fastening is achieved by two embeddings 12, which have, as the part 13 to be embedded, in each case a portion of the connecting piece 2, 3 that is made to extend in the direction of the axis of the insulating tube 4 and, as the embedding body 14, an end portion of the insulating tube 4. The embeddings 12 are formed by a casting process, in which a prefabricated preform of the shaft 1, including the connecting pieces 2, 3 and a fiber body, is encapsulated with polymer.

The embedding achieves positive engagement and freedom from play between the embedded connecting piece 2 or 3 and the insulating tube 4 and in this way allows great tensile forces and torques to be transmitted independently of an adhesive joint. Since this force transmission element is produced by a casting technique, there is no need for finishing of the insulating tube or for the connecting pieces to be bonded in place. Moreover, good quality of the insulating tube 4, and consequently also of the shaft or the force-transmission element 1, in particular with regard to advantageous dielectric behavior and good mechanical properties, can be achieved by maintaining precise control over the casting process.

Figure 3:
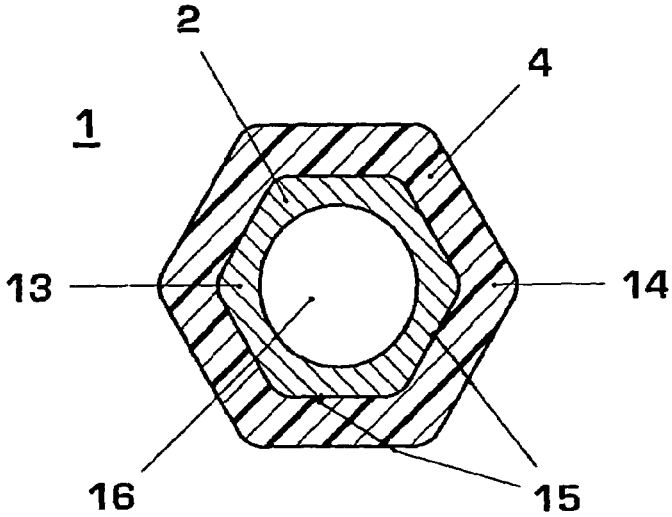
FIG. 3 shows a view in the direction of the arrow of a section taken along III-III through the shaft (shown enlarged) according to FIG. 2.

FIG. 3 shows that the embedded portion 13 of the connecting piece 2 is formed as a positively engaging element and has in the circumferential direction around the axis of the insulating tube 4 a profile 15 other than that of a circle, for example in the manner of a polygon. In this way, positive engagement is achieved between the insulating tube 4 and the connecting piece 2. In a corresponding way, positive engagement can also be achieved between the insulating tube 4 and the connecting piece 3. Instead of a polygon, the profile may also have an elliptical structure or other rotationally dependent structure. In this way, particularly good transmission behavior is achieved when great torques occur, as required for example of a drive shaft for a contact system of a high-current device. Depressions or bulges extending in the circumferential direction may possibly also be formed into the profile. As a result, positive engagement is additionally achieved under tensile loading.

Figure 5:
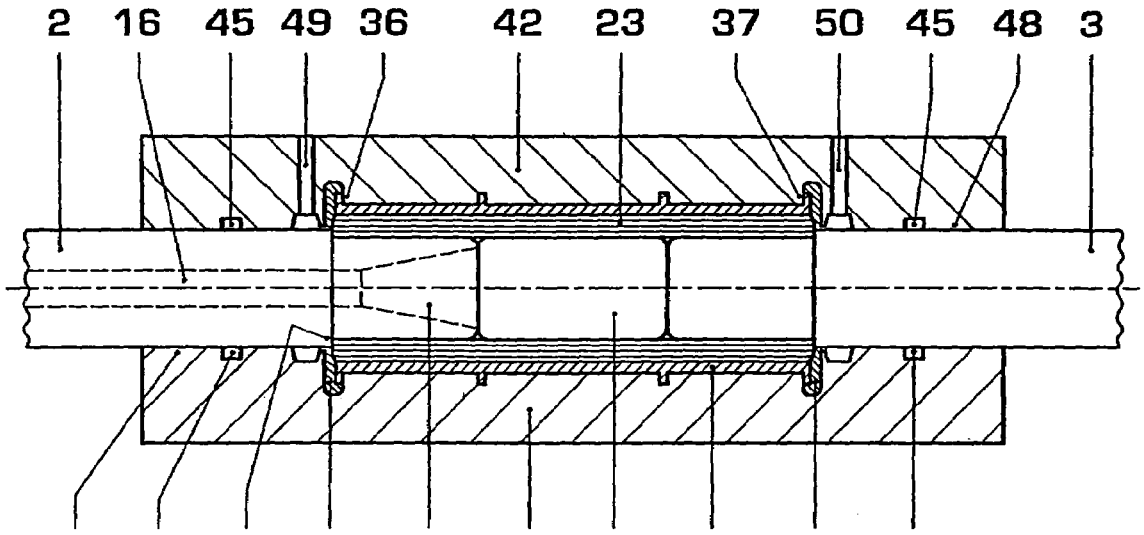
FIG. 5 shows a view of a section taken axially and parallel to the plane of the drawing through the casting mold of the device according to FIG. 4.
Figure 6:
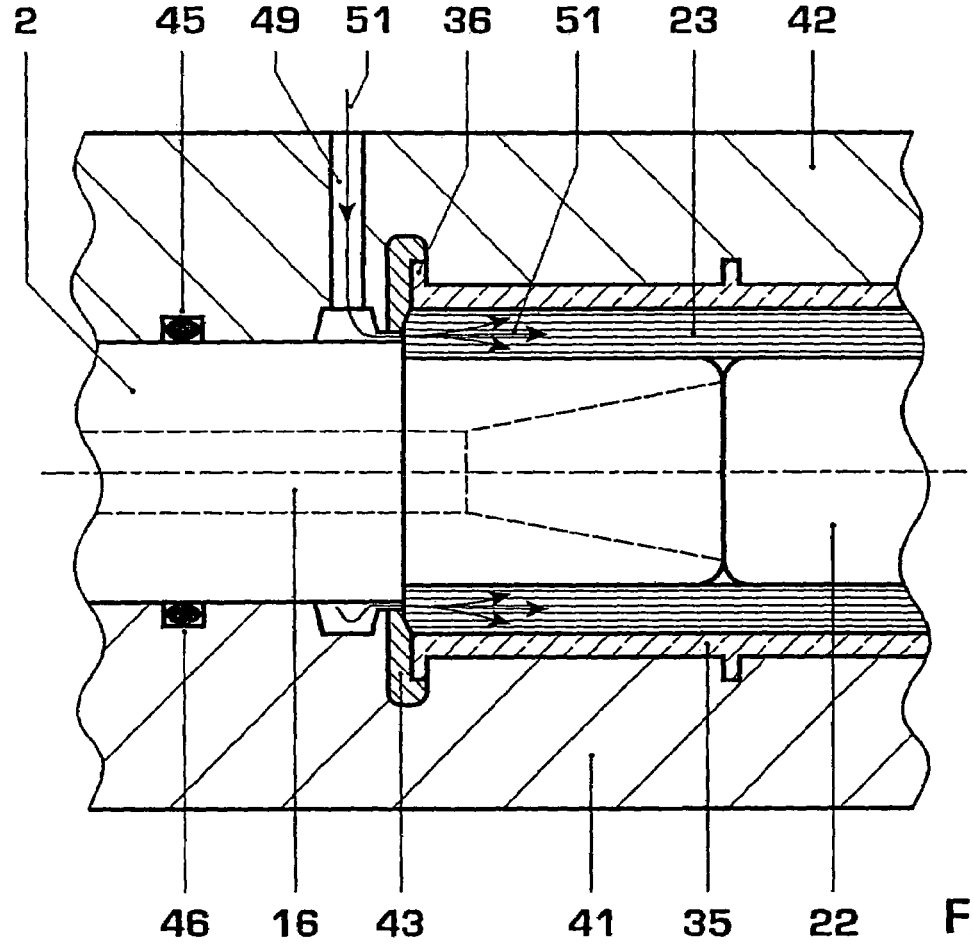
FIG. 6 shows an enlarged representation of part of the casting mold according to FIG. 5.

FIGS. 2 and 3 reveal that the connecting piece 2 includes a longitudinal channel 16 made to run in the direction of the axis of the insulating tube 4. A flexible molding 22 made of an elastomeric material, such a silicone, which is represented in FIGS. 5 and 6 and is used in the casting process during the production of the insulating tube 4 for supporting the inner wall of the fiber body, can be moved through this channel after the production of the shaft 1. The molding 22 has a circumferential surface adapted to the profile 15 and is advantageously made hollow. This is so because it can then be subjected to pressure from inside and consequently expand radially outward as a result of its flexible form.

It is evident from FIG. 2 that the fiber reinforcement of the insulating tube 4 is formed by winding fibers 11 laid layer by layer. Also symbolically indicated in FIG. 2 are reinforcing fibers 17 predominantly made to run radially through the layers of fiber 11. With a proportion of about 0.5 to 5%, preferably 1 to 3, these fibers bring about a particularly high torsional strength of the insulating tube 4, and consequently also of the shaft 1.

Figure 4:
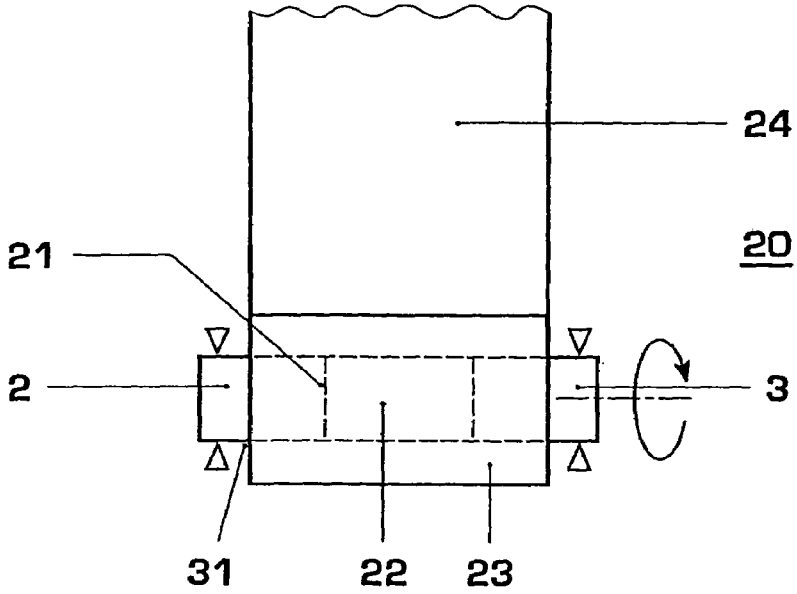
FIG. 4 shows a schematic representation of a device for producing the shaft according to FIG. 2.
Figure 4:
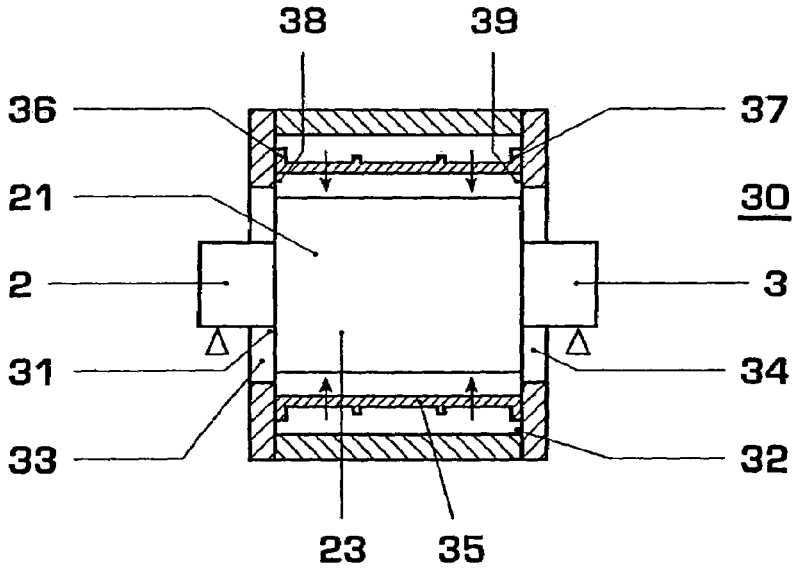
Figure 4:
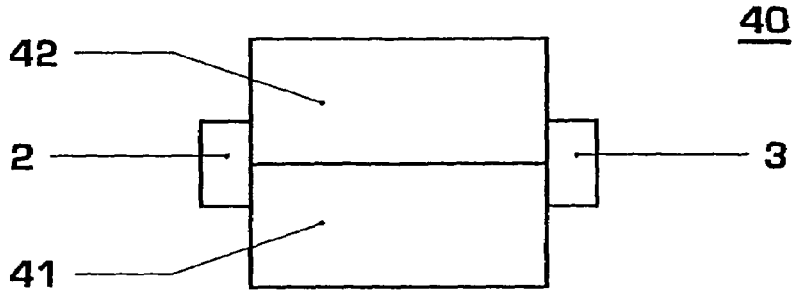

The force transmission element 1 according to FIGS. 2 and 3 can be produced with the device which can be seen in FIG. 4. This device includes a winding tool 20 with a rotatably mounted winding core 21. The winding core 21 is formed by the two connecting pieces 2, 3 and the flexible molding 22 arranged between the two connecting pieces, and serves for receiving a fiber body 23. The fiber body 23 is obtained by winding a prestressed laid structure of synthetic fibers 24, preferably based on aramid, with a weight per unit area of several hundred grams per $m^2$, for example 300 $g/m^2$. The fiber body 23 therefore has the layers of fibers 11 represented in FIG. 2. In addition, the fiber body 23 may be reinforced by the radially running fibers 17 represented in FIG. 2. A preform 31 largely corresponding to the finished shaft 1 with regard to its geometrical dimensions is then formed in the winding tool 20. This preform comprises the portions 13 of the connecting pieces 2, 3 that are to be embedded into the insulating tube 4 and are represented in FIG. 2.

The preform 31 is introduced into a shrink-fitting tool 30. The shrink-fitting tool has a hollow-cylindrically formed vacuum chamber 32, the two end faces of which respectively contain an opening 33 and 34 for introducing the preform 31. Provided in the interior of the chamber 32 is a flexible molding 35, which surround the fiber body 23 at a distance and, like the molding 22, consists of an elastomeric material, preferably silicone. The molding 35 is hollow-cylindrically formed and, like the molding 22, has a polygonal profile in the circumferential direction. Its two ends are respectively formed by the annular edges 36 and 37, acting as sealing bodies. These edges are supported in a vacuum-tight manner on sealing faces 38 and 39 made to run radially and enclosing the openings 33, 34. Before introducing the preform 31, negative pressure is applied to the vacuum chamber 32 and in this way the molding 35 is led radially to the outside, thereby forming prestress (representation according to FIG. 4). In the enlarged diameter of the molding 35, the preform then finds sufficient space when it is introduced into the shrink-fitting tool. By filling the vacuum chamber with air, the molding 35 is displaced inward (directional arrows according to FIG. 4) and shrink-fitted with a predetermined prestress onto the fiber body 23 of the preform 31.

The preform 31 and the flexible moldings 22 and 35 supporting its fiber body 23 are introduced into a two-part vacuum- and pressure-tight casting mold 40 with a lower mold 41 and an upper mold 42. This casting mold is represented in section in FIGS. 5 and 6. After removal of the upper mold 42, the preform 31 supported by the moldings 22, 35 and two rings 43, 44 is introduced into the lower mold 42. The two rings 43, 44 are made of metal, preferably a resin-resistant steel, and support the two edges 36, 37 of the molding 35 in a largely vacuum- and fluid-tight manner. After the preform 31 has been introduced into the lower mold 41, the upper mold 42 is applied and pressed against the lower mold 41 with the aid of fastening means. Sealing rings 45 and 46 then seal off the interior of the casting mold 40 from the outside in a largely vacuum- , pressure- and fluid-tight manner. The connecting pieces 2, 3 are led to the outside through. openings 47 and 48 in the casting mold 40. A further opening into the interior of the mold is represented by the longitudinal channel 16, through which an end of the balloon-like molding 22 that is open and can be connected to a pressurized gas source is led. Liquid polymer, for example epoxy resin, can be introduced into the interior of the mold through an opening 49. A further opening 50 serves for the venting of the interior of the mold and can be connected to a vacuum system.

For the production of the shaft or the force transmission element, firstly the interior of the mold is evacuated via the opening 50 and pressurized gas is introduced into the molding 22 via the longitudinal channel 16. The longitudinal channel 16 is sealed off from the outside by the molding 22 expanding as a result. As can be seen from FIG. 6, liquid polymer 51 is then fed in via the opening 49. The resin flows through an undesignated annular gap, located between the supporting ring 43 and the connecting piece 2, into the fiber body 23 and completely impregnates the latter. The molding 22, which is under pressure, has expanded and seals off the channel 16, avoids resin being able to escape through the longitudinal channel 16. The supply of polymer 51 is ended as soon as the fiber body 23 is completely impregnated. The openings 49 and 50 are closed. The pressurized flexible molding 22 and the molding 35, supported by the lower mold 41 and upper mold 42, then act in a shaping manner on the polymer-impregnated fiber body 23. Any gas bubbles which may still be present in the liquid polymer are at the same time compressed to dielectrically ineffective sizes. Under pressure, the polymer is then cured at elevated temperatures. Formed as a result is the insulating tube 4 that can be seen in FIG. 2, with the two embeddings 12 and the force transmission element formed as a shaft 1. After curing of the polymer, the molding 22 can be relieved of pressure and, because of its elastic deformability, removed from the interior of the casting mold 40, or the shaft 1, without being destroyed, through the longitudinal channel 16. The shaft 1 can be removed after the upper mold 42 has been removed from the lower mold 41.

LIST OF DESIGNATIONS

1 force transmission element, shaft
2,3 connecting pieces
4 insulating tube
5 adhesive joint
6 cone
7 circumferential surface
8 inner surface
9 mating cone
10 adhesion gap
11 layers of fiber
12 embedding
13 part to be embedded
14 end portion
15 profile

16 longitudinal channel
17 reinforcing fibers
20 winding tool
21 winding core
22 molding
23 fiber body
24 laid structure of synthetic fibers
30 shrink-fitting tool
31 preform
32 vacuum chamber
33,34 openings
35 molding
36,37 edges
38,39 sealing faces
40 casting mold
41 lower mold
42 upper mold
43,44 supporting rings
45,46 sealing rings
47,48,49,50 openings
51 liquid polymer
71 cavity
72 pressure-equalizing channel

The invention claimed is:

1. A shaft of a drive comprising two electrically conducting connecting pieces, which can be connected to different electric potentials, and an insulating tube, which is subjected to torsional loading introduced by the drive, wherein the two connecting pieces are respectively fastened to one of the two ends of the insulating tube, the shaft comprising an embedding for fastening at least one of the two connecting pieces to the insulating tube, the embedding comprises an embedded part, which is formed by an end portion of one of the two connecting pieces, and an embedding body, which is formed of the insulating tube produced by a casting process thereby producing a construction with positive engagement and freedom from play between the end portion of one of the two connecting pieces and the insulating tube, and, in the embedding, the end portion of the connecting piece comprising an outer periphery and the insulating tube comprising an inner periphery defining a form-fit connection between the embedded part and the embedding body, the outer periphery of the end portion and the inner periphery of the insulation tube having a non-circular cross-section thereby allowing torques introduced by the drive to be transmitted by the connecting pieces and insulating tube.

2. The shaft as claimed in claim 1, wherein the material of the insulating tube contains a fiber-reinforced polymer, the fiber reinforcement having a layered structure.

3. The shaft as claimed in claim 2, wherein one of the connecting pieces has a longitudinal channel made to run in the direction of the axis of the insulating tube.

4. The shaft as claimed in claim 2, wherein the fiber reinforcement has reinforcing fibers predominantly made to run radially through the layers of fiber.

5. The shaft as claimed in claim 4, wherein the proportion of predominantly radially running reinforcing fibers makes up about 0.5 to 5% of the fiber reinforcement.

6. The shaft as claimed in claim 4, wherein the proportion of predominantly radially running reinforcing fibers makes up about 1 to 3% of the fiber reinforcement.

7. The shaft of claim 1, wherein shaft can be used as a rotary shaft in a high-voltage carrying apparatus.

8. The apparatus of claim 7, wherein the apparatus comprises a high-voltage switch.

9. A shaft comprising two electrically conducting connecting pieces, which can be connected to different electric potentials, and an insulating tube, which is subjected to torsional loading, wherein the two connecting pieces are respectively fastened to one of the two ends of the insulating tube, the shaft comprising an adhesive joint for fastening at least one of the two connecting pieces to the insulating tube, the adhesive joint is formed by a cone formed into one end of the insulating tube and made to run from the circumferential surface to the inner surface of the insulating tube, and by a mating cone, which is formed into the at least one connecting piece, and by a gap formed by the cone and the mating cone, which gap is filled with adhesive, wherein a cavity bounded by the inner surface of the insulating tube and the connecting pieces is connected to a pressure-equalizing channel made to run out of the shaft.

10. The shaft as claimed in claim 9, wherein the material of the insulating tube contains a fiber-reinforced polymer, the fiber reinforcement of which is formed by winding fibers laid layer by layer.

11. The shaft as claimed in claim 10, wherein, the cone intersects the layers at an angle of about 10 to 30°, in relation to the axis of the insulating tube.

12. The shaft as claimed in claim 10, wherein the fiber reinforcement has reinforcing fibers predominantly made to run radially through the layers of fiber.

13. The shaft as claimed in claim 12, wherein the proportion of predominantly radially running reinforcing fibers makes up about 0.5 to 5% of the fiber reinforcement.

14. The shaft as claimed in claim 12, wherein the proportion of predominantly radially running reinforcing fibers makes up about 1 to 3% of the fiber reinforcement.

* * * * *